US006575350B2

(12) United States Patent
Evans et al.

(10) Patent No.: US 6,575,350 B2
(45) **Date of Patent: *Jun. 10, 2003**

(54) METHOD OF APPLYING A WEAR-RESISTANT LAYER TO A SURFACE OF A DOWNHOLE COMPONENT

(76) Inventors: Stephen Martin Evans, Standish, Gloucester (GB), GL10 3DA; Terry R. Matthias, 15 Bondend Road, Upton St. Leonards, Gloucestershire (GB), GL4 8AH; Tom Scott Roberts, 28 Hayward Close, Abbeymead, Gloucester (GB), GL4 4 RJ ( * ) Notice: Subject to any disclaimer, the term of this patent is extended or adjusted under 35 U.S.C. 154(b) by 0 days.

This patent is subject to a terminal disclaimer.

(21) Appl. No.: 09/800,242

(22) Filed: Mar. 6, 2001

(65) Prior Publication Data

US 2001/0030067 A1 Oct. 18, 2001

Related U.S. Application Data

(63) Continuation of application No. 09/340,984, filed on Jun. 28, 1999, now Pat. No. 6,234,261.

(30) Foreign Application Priority Data

Mar. 18, 1999 (GB) ..... 9906114

(51) Int. Cl.[7] ..... B23K 31/02
(52) U.S. Cl. ..... 228/122.1; 29/458
(58) Field of Search ..... 76/108.2, DIG. 12; 228/122.1; 29/458

(56) References Cited

U.S. PATENT DOCUMENTS

| | | | |
|---|---|---|---|
| 3,825,083 A | | 7/1974 | Flarity et al. |
| 5,049,164 A | | 9/1991 | Horton et al. |
| 5,178,222 A | | 1/1993 | Jones et al. |
| 5,282,513 A | | 2/1994 | Jones |
| 5,285,859 A | * | 2/1994 | Tibbitts |
| 5,626,909 A | | 5/1997 | Iacovangelo |
| 5,671,817 A | | 9/1997 | Smith et al. |
| 5,755,299 A | | 5/1998 | Langford, Jr. et al. |

FOREIGN PATENT DOCUMENTS

| | | |
|---|---|---|
| EP | 0 329 954 | 8/1993 |
| EP | 0 420 262 | 7/1995 |
| EP | 0 264 674 | 9/1995 |
| GB | 2 288 351 | 10/1995 |
| GB | 2 289 909 | 12/1995 |
| GB | 2 326 656 | 12/1998 |
| GB | 2 328 391 | 2/1999 |
| WO | WO88/09826 | 12/1988 |
| WO | WO99/05391 | 2/1999 |
| WO | WO00/45025 | 8/2000 |

* cited by examiner

*Primary Examiner*—P. W. Echols
(74) *Attorney, Agent, or Firm*—Jeffery E. Daly

(57) ABSTRACT

A method is disclosed comprising the steps of locating, on a surface of a downhole component, a plurality of thermally stable polycrystalline diamond (TSP) bearing elements, and then applying to the surface a settable facing material which bonds to the surface between the bearing elements and embraces the elements to hold them in place. A method in which bearing elements each comprising a body of TSP at least partly surrounded by a layer of less hard material are secured to the surface by welding or brazing part of the surface of each bearing element which comprises said less hard material to said component is also described.

17 Claims, 2 Drawing Sheets

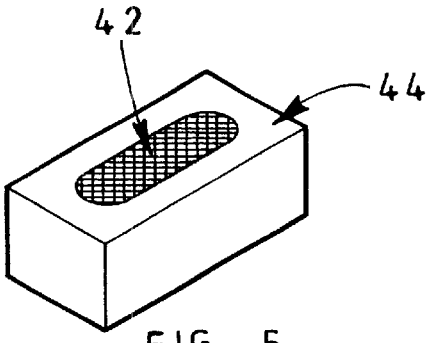
FIG 5
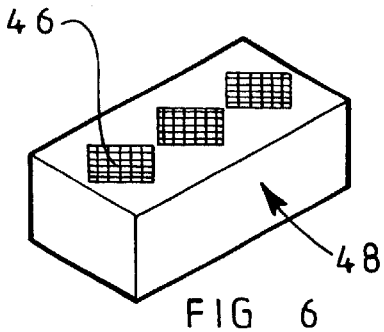
FIG 6
FIG 7
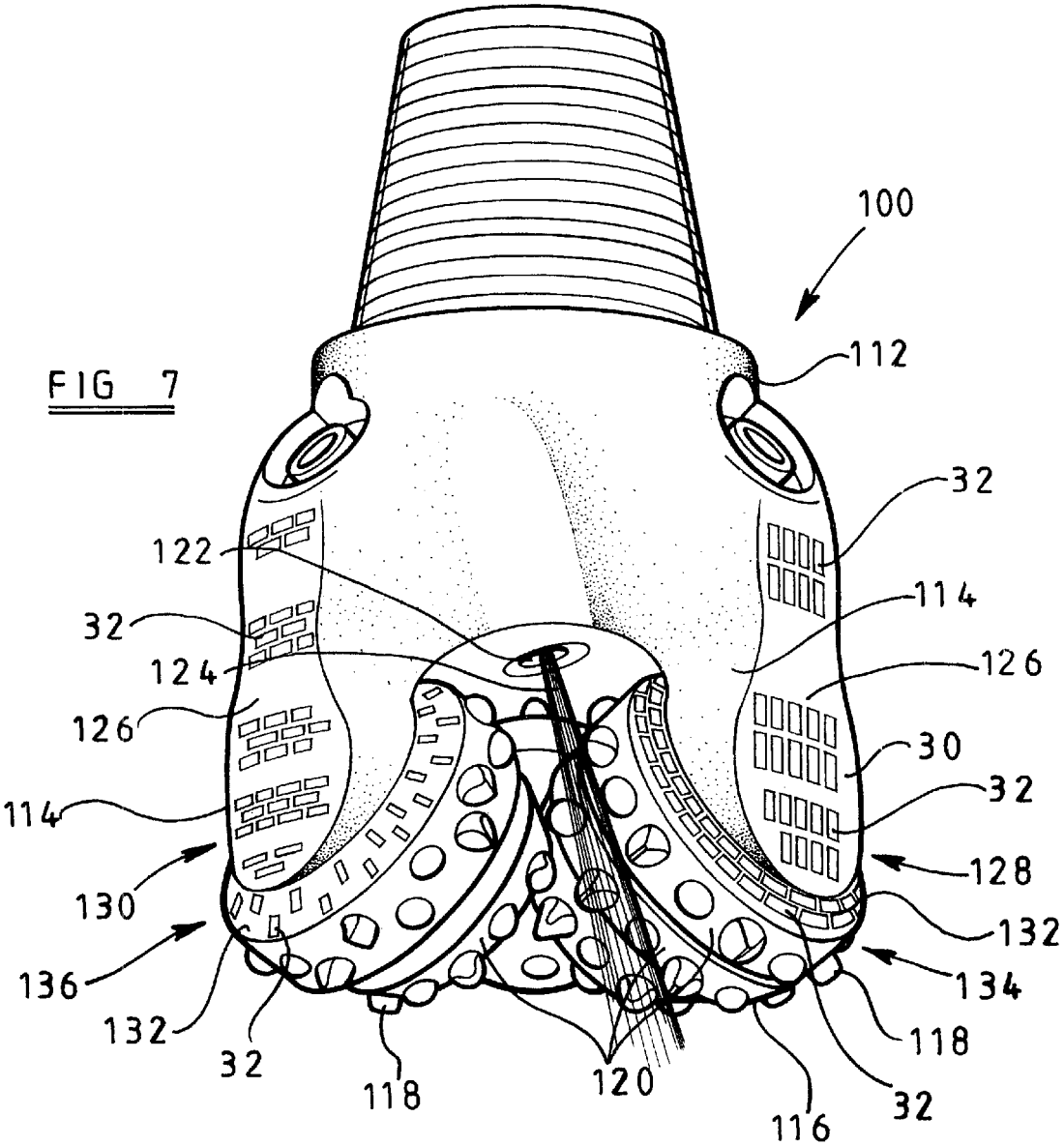

METHOD OF APPLYING A WEAR-RESISTANT LAYER TO A SURFACE OF A DOWNHOLE COMPONENT

This is a Continuation of U.S. patent application Ser. No. 09/340,984, filed Jun. 28, 1999, now U.S. Pat. No. 6,234,261 by Stephen Martin Evans et al, entitled "Method of Applying a Wear-Resistant Layer to a Surface of a Downhole Component".

BACKGROUND OF THE INVENTION

1. Field of the Invention

The invention relates to methods of applying a wear-resistant layer to a surface of a downhole component for use in subsurface drilling.

2. Description of Related Art

The invention is applicable to downhole components of the kind which include at least one surface which, in use, engages the surface of the earthen formation surrounding the borehole. The invention relates particularly to rotary drill bits, for example of the drag-type kind having a leading face on which cutters are mounted and a peripheral gauge region for engagement with the surrounding walls of the borehole in use or of the rolling cutter kind. The invention will therefore be described with particular reference to polycrystalline diamond compact (PDC) drag-type and rolling cutter type drill bits, although it will be appreciated that it is also applicable to other downhole components having bearing surfaces. For example, bearing surfaces may be provided on downhole stabilizers, motor or turbine stabilizers, or modulated bias units for use in steerable rotary drilling systems, for example as described in British Patent No. 2289909. Such bias units include hinged paddles having bearing surfaces which engage the walls of the borehole in order to provide a lateral bias to the bottom hole assembly.

In all such cases the part of the downhole component providing the bearing surface is not normally formed from a material which is sufficiently wear-resistant to withstand prolonged abrasive engagement with the wall of the borehole and it is therefore necessary to render the bearing surface more wear-resistant. For example, the bodies of rotary drag-type and rolling cutter type drill bits are often machined from steel and it is therefore necessary to apply bearing elements to the gauge portion of such drill bit to ensure that the gauge is not subject to rapid wear through its engagement with the walls of the borehole. This is a particular problem with steel bodied drill bits where the gauge of the bit comprises a single surface extending substantially continuously around the whole periphery of the bit, for example as described in British Patent Specification No. 2326656.

One well known method of increasing the wear-resistance of the gauge of a drag-type or rolling cutter type drill bit is to form the gauge region with sockets in which harder bearing inserts are received. One common form of bearing insert comprises a circular stud of cemented tungsten carbide, the outer surface of which is substantially flush with the outer surface of the gauge. Smaller bodies of natural or synthetic diamond may be embedded in the stud, adjacent its outer surface. In this case the stud may comprise, instead of cemented tungsten carbide, a body of solid infiltrated tungsten carbide matrix material in which the smaller bodies of natural or synthetic diamond are embedded. Bearing inserts are also known using polycrystalline diamond compacts having their outer faces substantially flush with the gauge surface.

Another known method of increasing the wear-resistance of the gauge surface of a PDC drill bit is to cover the surface of the gauge, or a large proportion thereof with arrays of rectangular tiles of tungsten carbide. Such tiles may be packed more closely over the surface of the gauge than is possible with bearing inserts, of the kind mentioned above, which must be received in sockets, and therefore allow a greater proportion of the area of the gauge surface to be covered with wear-resistant material at lesser cost. However, it would be desirable to use bearing elements which have greater wear-resistance than tungsten carbide tiles.

A known method for increasing the wear-resistance of the rolling cone cutter in rolling cutter bits is to include one or more rows of inserts on the gauge reaming portion of the rolling cutter. Typically, the inserts are cylindrical bodies which are interference-fitted into sockets formed on the gauge reaming surface of the rolling cutter, as shown in U.S. Pat. No. 5,671,817. The inserts may be formed of a very hard and wear and abrasion resistant grade of tungsten carbide, or may be tungsten carbide cylinders tipped with a layer of polycrystalline diamond. In addition, the gauge portion of each bit leg facing the borehole wall may be provided with welded-on hard facing and/or the same type of tungsten carbide cylinders are as fitted into the rolling cutters.

A material which is significantly more wear-resistant than tungsten carbide, and is also available in the form of rectangular blocks or tiles, is thermally stable polycrystalline diamond (TSP). As is well known, thermally stable polycrystalline diamond is a synthetic diamond material which lacks the cobalt which is normally present in the polycrystalline diamond layer of the two-layer compacts which are frequently used as cutting elements for rotary drag-type drill bits. The absence of cobalt from the polycrystalline diamond allows the material to be subjected to higher temperatures than the two-layer compacts without sufficient significant thermal degradation, and hence the material is commonly referred to as "thermally stable".

In one commercially available form of thermally stable polycrystalline diamond the product is manufactured by leaching the cobalt out of conventional non-thermally stable polycrystalline diamond. Alternatively the polycrystalline diamond may be manufactured by using silicon in place of cobalt during the high temperature, high pressure pressing stage of the manufacture of the product.

While TSP has the wear-resistance characteristics appropriate for a bearing element on a downhole component, it has hitherto been difficult to mount TSP on downhole components. Where blocks of TSP are to be used as cutting elements on drag-type drill bits it is necessary either to mold the bit body around the cutting elements, using a well-known powder metallurgy process, or to embed the blocks into bodies of less hard material which are then secured in sockets in the bit body. Where a bearing element is to be applied to a surface of a downhole component for the purpose of wear-resistance, however, it is preferable for the bearing element to be mounted on the surface of the component, particularly if the component is formed by machining, from steel or other metal, so that the bearing element cannot readily be embedded in the component. The present invention therefore sets out to provide novel methods for mounting TSP bearing elements on to a bearing surface of a downhole component.

SUMMARY OF THE INVENTION

According to one aspect of the invention, there is provided a method of applying a wear-resistant layer to a surface of a downhole component for use in subsurface drilling, the method comprising locating on said surface in mutually spaced relationship a plurality of bearing elements formed, at least in part, from thermally stable polycrystalline diamond (TSP), and then applying to said surface a layer of a settable facing material which bonds to the surface between the bearing elements and embraces said elements so as to hold them in place on the surface.

Each bearing element may be held in position on said surface, prior to application of the layer of facing material, by welding, brazing, an adhesive, or any other suitable form of bonding. Alternatively or additionally, each bearing element may be held in position on said surface by mechanical locating means. The mechanical locating means may comprise formations, such as grooves or recesses, on said surface for mechanical engagement with parts of the bearing element. Alternatively or additionally, each bearing element may be temporarily held in position on said surface, while the layer of facing material is applied to it, by a mechanical holding device which is separate from the drill bit and is removed after application of the facing layer has secured the bearing elements in position.

In any of the above arrangements each bearing element may comprise a body consisting solely of thermally stable polycrystalline diamond, or may comprise a body of thermally stable polycrystalline diamond which is at least partly surrounded by a layer of a less hard material.

In the latter case the layer of less hard material may comprise a thin coating pre-applied to some or, preferably, all of the surface of the body of thermally stable polycrystalline diamond. The coating is preferably formed from a material of high electrical conductivity, such as nickel or nickel alloy. In this case the bearing element may be held in position on the surface of the component by electrical resistance welding. The body of thermally stable polycrystalline diamond may be pre-coated with a layer of a carbide-forming metal before application of the coating of less hard material, since the carbide-forming metal may form a stronger bond with the TSP than does the nickel or nickel alloy alone.

In an alternative arrangement, the layer of less hard material at least partly surrounding the body of TSP may be in the form of a larger body of less hard material in which the body of TSP is at least partly embedded. The body of less hard material may for example comprise solid infiltrated tungsten carbide matrix material or sintered tungsten carbide.

The body of TSP may have at least one face which is substantially co-planar with a face of the larger body of less hard material. The co-planar face preferably constitutes an outer bearing surface which faces outwardly away from the surface of the component.

In any of the above arrangements the layer of facing material may have a depth which is not greater than the depth of the bearing element, so as to leave the outer bearing surface of each bearing element exposed. Alternatively, the layer of facing material may have a depth which is greater than the depth of the bearing element, so that the outer bearing surface of each bearing element is covered by a thin layer of the facing material. The thin layer of facing material may be ground away before use of the bit, or may be left to be worn away in use.

The settable facing material is preferably a hardfacing material which is harder than the material forming the surface of the component to which it is applied.

The surface of the downhole component may be formed from steel, as mentioned above, and the hardfacing material may comprise any hardfacing material commonly used for the hardfacing of drill bits or other downhole components formed from steel. For example, the hardfacing material may comprise a nickel, chromium, silicon, boron alloy powder applied to the surface by a flame spraying process. The powder may include particles of tungsten carbide.

In any of the above arrangements, each bearing element may be shaped so as to become mechanically interlocked with the surrounding layer of facing material after application of such material to the surface of the downhole component.

According to a second aspect of the invention, there is provided a method of applying a wear-resistant layer to a surface of a downhole component for use in subsurface drilling, the method comprising forming a plurality of bearing elements, each comprising a body of TSP at least partly surrounded by a layer of less hard material, and then bonding each bearing element to the surface of the component by welding or brazing to the surface of the component a part of the surface of the bearing element which comprises said less hard material surrounding the body of TSP.

In this aspect of the invention also, the layer of less hard material may comprise a thin coating pre-applied to some or, preferably, all of the surface of the body of thermally stable polycrystalline diamond. The coating is preferably formed from a material of high electrical conductivity, such as nickel or nickel alloy. In this case the bearing element may be held in position on the surface of the component by electrical resistance welding. The body of thermally stable polycrystalline diamond may be pre-coated with a layer of a carbide-forming metal before application of the coating of less hard material, since the carbide-forming metal may form a stronger bond with the TSP than does the nickel or nickel alloy alone.

In an alternative arrangement, the layer of less hard material at least partly surrounding the body of TSP may be in the form of a larger body of less hard material in which the body of TSP is at least partly embedded. The body of less hard material may for example comprise solid infiltrated tungsten carbide matrix material or sintered tungsten carbide.

The body of TSP may have at least one face which is substantially co-planar with a face of the larger body of less hard material. The co-planar face preferably constitutes an outer bearing surface which faces outwardly away from the surface of the component.

Each bearing element may be inter engaged with a locating formation on the surface of the component to which it is welded or brazed. For example, the locating formation may comprise a socket or recess into which the bearing element is at least partly received. The bearing element may be fully received in the socket or recess so that an exposed surface of the bearing element is substantially flush with the surface of the component surrounding the socket or recess.

In any of the above arrangements the downhole component may, as previously mentioned, comprise a drill bit, a stabilizer, a modulated bias unit for use in steerable rotary drilling, or any other downhole component having one or more bearing surfaces which engage the wall of the borehole in use.

Where the component is a drill bit, it may be a rotary drag-type drill bit having a leading face on which the cutters are mounted and a peripheral gauge region for engagement with the walls of the borehole, in which case the methods according to the invention may be used to apply bearing elements to the outer surface of the gauge region.

The methods of the invention may also be applied to increase the wear-resistance of surfaces of roller-cone bits or other types of rock bit.

The invention also includes within its scope a downhole component, such as a drill bit, having at least one surface to which bearing elements have been applied by any of the methods referred to above.

BRIEF DESCRIPTION OF THE DRAWINGS

FIGS. 5 and 6 are diagrammatic perspective views of further examples of bearing element which may be used in the method of the invention.

FIG. 7 is a perspective view of a rolling cutter drill bit, to the gauge sections of which wear-resistant layers have been applied.

DETAILED DESCRIPTION OF THE PREFERRED EMBODIMENTS

Figure 1:
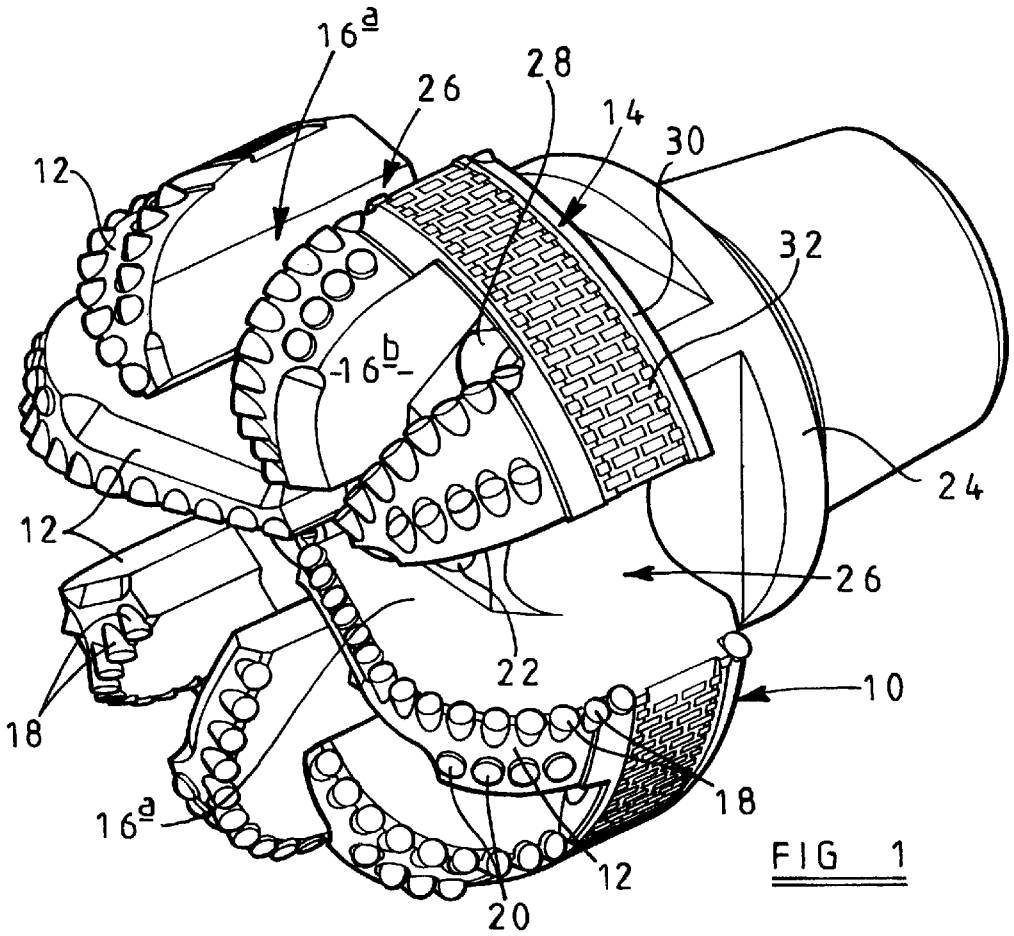
FIG. 1 is a perspective view of a PDC drill bit to the gauge sections of which wear-resistant layers have been applied in accordance with the method of the present invention.

Referring to FIG. 1: the PDC drill bit comprises a bit body 10 machined from steel and having eight blades 12 formed on the leading face of the bit and extending outwardly from the axis of the bit body towards the peripheral gauge region 14. Channels 16*a*, 16*b* are defined between adjacent blades.

Extending side-by-side along each of the blades 12 is a plurality of cutting structures, indicated at 18. The precise nature of the cutting structures does not form a part of the present invention and they may be of any appropriate type. For example, as shown, they may comprise circular preform PDC cutting elements brazed to cylindrical carriers which are embedded or otherwise mounted in the blades, the cutting elements each comprising a preform compact having a polycrystalline diamond front cutting table bonded to a tungsten carbide substrate, the compact being brazed to a cylindrical tungsten carbide carrier. In another form of cutting structure the substrate of the preform compact is of sufficient axial length to be mounted directly in the blade, the additional carrier then being omitted.

Back-up abrasion elements or cutters 20 may be spaced rearwardly of some of the outer cutting structures, as shown.

Nozzles 22 are mounted in the surface of the bit body between the blades 12 to deliver drilling fluid outwardly along the channels, in use of the bit. One or more of the nozzles may be so located that they can deliver drilling fluid to two or more channels. All of the nozzles communicate with a central axial passage (not shown) in the shank 24 of the bit, to which drilling fluid is supplied under pressure downwardly through the drill string in known manner.

Alternate channels 16*a* lead to respective junk slots 26 which extend upwardly through the gauge region 14, generally parallel to the central longitudinal axis of the drill bit, so that drilling fluid flowing outwardly along each channel 16*a* flows upwardly through the junk slot 26 between the bit body and the surrounding formation, into the annulus between the drill string and the wall of the borehole.

Each of the other four alternate channels 16*b* does not lead to a conventional junk slot but continues right up to the gauge region 14 of the drill bit. Formed in each such channel 16*b* adjacent gauge region is a circular opening 28 into an enclosed cylindrical passage which extends through the bit body to an outlet (not shown) on the upper side of the gauge region 14 which communicates with the annulus between the drill string and the borehole.

Accordingly, the gauge region 14 of the drill bit comprises four peripherally spaced bearing surfaces 30 each bearing surface extending between two junk slots 26 and extending continuously across the outer end of an intermediate channel 16*b*.

In accordance with the present invention, there is applied to each peripheral bearing surface 30 in the gauge region a wear-resistant layer comprising an array of rectangular bearing elements 32 in mutually spaced relationship on the bearing surface 30, each bearing element being formed, at least in part from thermally stable polycrystalline diamond.

In the example shown in FIG. 1 the bearing elements 32 are rectangular and closely packed in parallel rows extending generally axially of the drill bit. However, this arrangement is by way of example only and many other shapes and arrangements of bearing elements may be employed, but still using the methods according to the present invention. For example the bearing elements might be square, circular or hexagonal and may be arranged in any appropriate pattern. Also, the bearing elements may be more widely spaced than is shown in FIG. 1 and may cover a smaller proportion of the surface area of the bearing surface 30.

Referring now to FIG. 7. A perspective view of a rolling cutter drill bit 100 is shown. The rolling cutter drill bit 100 has a body portion 112 and a plurality of legs 114 which each support rolling cutters 116. A typical rolling cutter 116 has a plurality of cutting inserts 118 arranged in circumferential rows 120. An orifice arrangement 122 delivers a stream of drilling fluid 124 to the rolling cutter 116 to remove the drilled earth, in use. Weight is applied to the rolling cutter drill bit 100, and the bit 100 is rotated. The earth then engages the cutting inserts 118 and causes the rolling cutters 116 to rotate upon the legs 114, effecting a drilling action.

The gauge portion 126 of each leg 114 may define a bearing surface which engages the borehole wall during operation. This engagement often causes excessive wear of the gauge portion 126 of the leg 114. In order to minimize the wear, a plurality of rectangular bearing elements 32 are provided, the elements 32 being spaced apart in either a vertical alignment 128 or horizontal alignment 130 on the gauge portion 126 of the leg(s) 114. The particular arrangement of bearing elements 32 used will depend upon several factors, such as the curvature of the gauge portion 126, the amount of wear resistance required, and the bit size. Although the vertical alignment 128 and the horizontal alignment 130 are shown on separate legs in the figure, it is anticipated that both may be used on a single gauge portion 126 of a leg 114.

Each rolling cutter 116 has a gauge reaming surface 132 which defines a further bearing surface and also experiences excessive wear during drilling. The rectangular bearing elements 32 may be used on the gauge reaming surface 132 to minimise this wear. The advantage of placing the rectangular bearing elements 32 on the gauge reaming surface 132 of the rolling cutter 116 is that they can be placed in a particularly dense arrangement compared to the traditional interference fitted cylindrical cutting elements. The rectangular bearing elements 32 may be placed in a circumferential manner on the gauge reaming surface 132 of the rolling cutter 116 as indicated by numeral 134. Alternately, the rectangular bearing elements 32 may be in a longitudinal arrangement as indicated by numeral 136. It is anticipated that a combination of longitudinal and circumferential arrangements of the rectangular bearing elements 32 would also be suitable.

The method of the present invention also allows the rectangular bearing elements 32 to be placed on the gauge reaming surface 132 of the rolling cutter 116 without particular regard to the placement of the cutting inserts 118. Prior to the invention, great care was required to arrange the cylindrical cutting elements of the gauge reaming surface 132 in a manner that prevented the bases of their mating sockets from overlapping.

Figure 2:
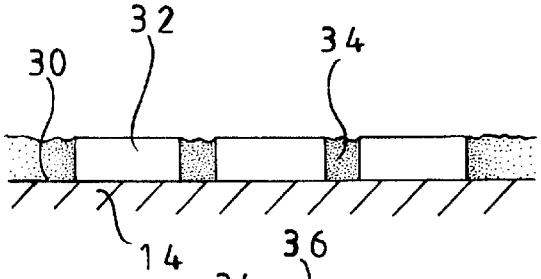
FIG. 2 is a diagrammatic enlarged cross-section of a part of the gauge section of the drill bit, showing the structure of the wear-resistant layer.
Figure 3:
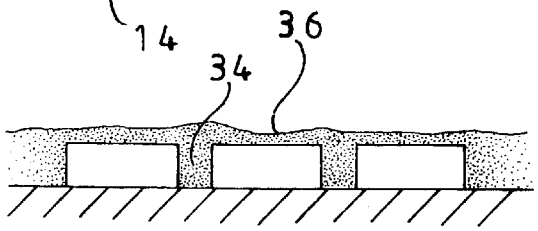
FIGS. 3 and 4 are similar views to FIG. 2 showing alternative methods of forming the wear-resistant layer.
Figure 4:
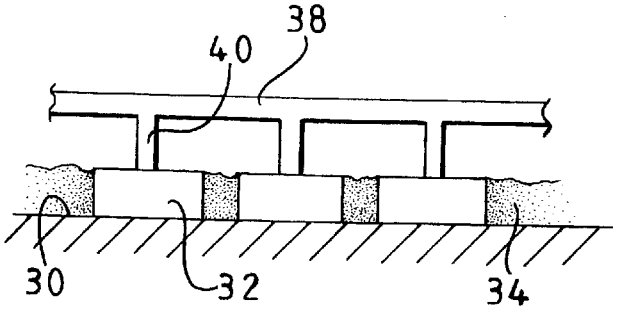

FIGS. 2–4 show diagrammatic cross-sections through the bearing surface 30 and applied wear-resistant layer, and methods of applying the wear-resistant layer will now be described with reference to these figures.

As will be seen from FIG. 2, the bearing elements 32 lie on the outer bearing surface 30 of the gauge portion 14 of the drill bit and the spaces between adjacent bearing elements 32 are filled with a settable hardfacing material 34.

In one method according to the invention, the bearing elements 32 comprise solid blocks or tiles of TSP and are first temporarily attached to the bearing surface 30 in the desired configuration. The settable hardfacing material 34 is then applied to the spaces between the TSP blocks 32 so as to bond to the bearing surface 30 of the drill bit and to the blocks themselves. Upon solidification, the hardfacing material 34 serves to hold the TSP elements 32 firmly in position on the surface 30.

The hardfacing material 34 may be of any of the kinds commonly used in providing a hardfacing to surface areas of drill bits, and particularly to steel bodied drill bits. For example, the hardfacing material may comprise a powdered nickel, chromium silicon, boron alloy which is flame sprayed on to the surface 30 using a well known hardfacing technique. The hardfacing may also be provided by other known techniques such as electrical plating, PVD, and metal spraying.

In the arrangement shown in FIG. 2 the hardfacing material 34 is in the form of a broken layer of generally the same depth as the TSP bearing elements 32 so that the outer surfaces of the bearing elements are substantially flush with the outer surface of the hardfacing layer. In the alternative arrangement shown in FIG. 3 the hardfacing layer 34 is applied to a depth which is greater than the depth of the elements 32 so as to overlie the outer faces of the bearing elements, as indicated at 36. The overlying layer 36 can be left in position so that, during use of the bit the layer 36 will wear away exposing the surfaces of the TSP bearing elements 32 which will then bear directly on the surface of the wall of the borehole. However, if required, the layer 36 may be ground away to expose the outer surfaces of the bearing elements before the bit is used.

Various methods may be used for temporarily attaching the bearing elements 32 to the bearing surface 30. For example, the bearing elements may be temporarily attached by using a suitable adhesive. However, a more reliable and stronger attachment is provided by welding or brazing the bearing elements to the surface 30. Since it is extremely difficult to weld or braze TSP directly to steel using conventional techniques, such as electrical-resistance welding, the TSP blocks are preferably coated with a less hard material, of higher electrical conductivity, before welding or brazing them to the surface 30. For example, the blocks may be coated with a thin layer of nickel or a nickel alloy, for example by using the techniques of electroless plating, CVD, or immersion in a molten alloy. Before coating the TSP with the nickel or nickel alloy, the TSP blocks may first be coated with a suitable carbide-forming metal, since such metal will bond to the TSP forming a firmly attached base surface to which the nickel or nickel alloy coating may subsequently be applied. Once the TSP blocks have had a suitable coating layer applied thereto, the blocks may more readily be welded or brazed to the surface 30, for example by using electrical-resistance spot welding.

Instead of temporarily attaching the TSP blocks by an adhesive, welding, brazing or similar technique, the blocks may be mechanically held in position on the surface 30 during application of the hardfacing layer and such an arrangement is shown diagrammatically in FIG. 4. In this case a temporary clamping mechanism 38 is mounted adjacent the bearing surface 30 and has individual clamping members 40 which bear against the outer surfaces of the TSP blocks 32 and hold the blocks firmly in the desired position against the surface 30 while the hardfacing layer 34 is applied to the surface 30. This mechanical holding technique might also be used in combination with the adhesive, welding or brazing techniques described in relation to FIGS. 2 and 3.

In any of the arrangements described the bearing surface 30 may be preformed with appropriate formations to assist in locating or holding the TSP elements 32 on the surface 30. For example, each element 32 may be partly received in a suitably shaped groove in the bearing surface 30 or in an individual recess which matches the shape of the element. In another arrangement the undersides of the elements 32 are preformed with shaped formations which mechanically inter-engage with corresponding shaped formations on the surface 30.

In any of the described arrangements the sides of the elements 32 may be so shaped that they mechanically interlock with the surrounding hardfacing material. For example, the elements may increase in width towards the surface 30.

In the above-described arrangements, the hardfacing layer 34 serves to hold the TSP elements 32 on the bearing surface 30, the welding or brazing of the elements 32 to the surface 30 merely serving to locate the elements temporarily in the desired configuration on the bearing surface while the hardfacing layer is applied. However, since the above-described coating of the TSP elements enables them to be welded or brazed to the bearing surface 30, arrangements are also possible where the TSP elements are welded or brazed to the bearing surface with sufficient strength that the hardfacing layer 34 may be dispensed with, each element 32 being held on the bearing surface 30 by the welded or brazed joint alone. In this case it may be desirable for the elements 32 to be wholly or partly received in recesses or grooves in the bearing surface 30 in order to improve the strength of the attachment of the elements to the surface.

In the above-described arrangements, the bearing elements 32 have been described as being either plain blocks of TSP or as being blocks of TSP coated with a thin layer of a less hard material, which is preferably of higher electrical conductivity than the TSP in order to permit electrical-resistance welding. However, other forms of bearing element incorporating TSP are possible and two such arrangements are shown in FIGS. 5 and 6.

In the arrangement of FIG. 5 a central block 42 of TSP, having rounded ends, is embedded in a larger surrounding block 44 of a different and less hard material, such as sintered tungsten carbide or solid infiltrated tungsten carbide matrix. The block 42 may extend through the entire thickness of the surrounding block 44 so that the surface of the TSP is exposed at both the upper and lower sides of the block, but preferably the TSP is exposed at only the upper surface of the block, in order to provide a larger area of the less hard material at the lower side. In the alternative arrangement shown in FIG. 6 a number of TSP blocks 46 are embedded in a surrounding larger block 48 of sintered tungsten carbide, solid infiltrated tungsten carbide matrix or other suitable material. In the arrangements shown three generally rectangular blocks 46 of TSP are shown embedded in the larger block 48, but it will be appreciated that any other suitable shape or arrangement of the TSP blocks may be employed.

Composite, bearing elements of the general kind shown in FIGS. 5 and 6 may be used, instead of the plain or coated blocks of TSP, in any of the methods described above. Thus, the blocks 42, 44 or 46, 48 may be temporarily attached to the bearing surface of the drill bit by an adhesive, welding or brazing, prior to application of the hardfacing layer. Alternatively, the blocks may be secured to the bearing layer solely by welding or brazing. In either case it will be the material of the outer block 44 or 48 which is welded or brazed to the bearing surface and, as mentioned above, it is therefore desirable for the block of TSP 42 or 46 not to be exposed at the lower side of the block so as to provide the maximum possible area of contact between the block 44, 48 and the bearing surface, so as to improve the strength of the weld or brazed joint.

Similar techniques to these described hereinbefore are suitable for use in securing the bearing elements 32 to the bearing surfaces of the drill bit illustrated in FIG. 7.

Although the invention has been described with particular reference to applying a wear-resistant surface to the gauge section of a drag-type or rolling cutter type steel-bodied drill bit, as previously mentioned the invention is not limited to this particular application and may be used for applying TSP-incorporating bearing elements to a bearing surface of any other downhole component, such as a stabiliser, or a modulated bias unit.

Whereas the present invention has been described in particular relation to the drawings attached hereto, it should be understood that other and further modifications, apart from those shown or suggested herein, may be made within the scope and spirit of the present invention.

What is claimed:

1. A method of applying a wear-resistant layer to a surface of a downhole component for use in subsurface drilling, the method comprising forming a plurality of bearing elements, each comprising a body of thermally stable polycrystalline diamond at least partly surrounded by a layer of less hard material, and then bonding each bearing element to the surface of the component by welding or brazing to the surface of the component a part of the surface of the bearing element which comprises said less hard material surrounding the body of thermally stable polycrystalline diamond wherein the layer of less hard material comprises a thin coating pre-applied to at least part of the surface of the body of thermally stable polycrystalline diamond.

2. A method according to claim 1, wherein the coating is formed from a material of high electrical conductivity.

3. A method according to claim 2, wherein the material of the coating is nickel.

4. A method according to claim 2, wherein the material of the coating is a nickel alloy.

5. A method according to claim 2, wherein the bearing element is held in position on the surface of the component by a weld deposit made by electrical resistance welding.

6. A method according to claim 1, wherein the body of thermally stable polycrystalline diamond is pre-coated with a layer of a carbide-forming metal before application of the layer of less hard material.

7. A method according to claim 1, wherein the layer of less hard material at least partly surrounding the body of thermally stable polycrystalline diamond is in the form of a larger body of less hard material in which the body of thermally stable polycrystalline diamond is at least partly embedded.

8. A method according to claim 7, wherein the body of thermally stable polycrystalline diamond has at least one face which is substantially co-planar with a face of the larger body of less hard material.

9. A method according to claim 1, wherein each bearing element is inter engaged with a locating formation on the surface of the component.

10. A method according to claim 9, wherein the formation comprises a socket or recess into which the bearing element is at least partly received.

11. A method according to claim 10, wherein the bearing element is fully received in the socket or recess so that an exposed surface of the bearing element is substantially flush with the surface of the component surrounding the socket or recess.

12. A method according to claim 1, wherein the downhole component comprises a drill bit.

13. A method according to claim 12, wherein the drill bit is a rotary drag-type drill bit.

14. A method according to claim 13, wherein the surface forms a bearing surface of a gauge region of the drill bit.

15. A method according to claim 12, wherein the drill bit is a rolling cutter type drill bit.

16. A method according to claim 15, wherein the surface is defined by a gauge portion of a leg of the drill bit.

17. A method according to claim 15 wherein the surface is defined by a gauge reaming surface of a rolling cutter of the drill bit.

* * * * *